US006698796B2

(12) United States Patent
Kurahashi

(10) Patent No.: US 6,698,796 B2
(45) Date of Patent: Mar. 2, 2004

(54) COVER FOR AN ALBUM AND THE LIKE AND A BINDING METHOD USING THE SAME

(75) Inventor: Shingo Kurahashi, Shimane (JP)

(73) Assignee: Nakabayashi Co., Ltd. (JP)

( * ) Notice: Subject to any disclaimer, the term of this patent is extended or adjusted under 35 U.S.C. 154(b) by 0 days.

(21) Appl. No.: 09/924,895

(22) Filed: Aug. 8, 2001

(65) Prior Publication Data

US 2002/0050710 A1 May 2, 2002

(51) Int. Cl.[7] ..... B42D 3/00; B42C 7/00; B42F 13/00

(52) U.S. Cl. ..... 281/29; 281/15.1; 281/21.1; 281/23; 281/36; 412/1; 412/3; 412/4; 412/5; 412/6; 412/8; 412/17; 412/28; 412/30; 412/36; 402/73

(58) Field of Search ..... 281/21.1, 29, 36, 281/23, 15.1; 412/3, 4, 5, 6, 1, 8, 17, 28, 30, 36; 402/73

(56) References Cited

U.S. PATENT DOCUMENTS 1,844,516 A * 2/1932 Meyer et al. ..... 412/8
3,215,450 A * 11/1965 Peterson et al. ..... 281/29
3,840,254 A * 10/1974 Shatzkin ..... 281/21.1
3,870,344 A * 3/1975 Heller et al. ..... 281/21.1
3,925,126 A * 12/1975 Leatherman et al. ..... 156/73.6
3,964,769 A * 6/1976 Shatzkin ..... 281/21.1
3,964,770 A * 6/1976 Abildgaard et al. ..... 281/29
4,091,487 A * 5/1978 Axelrod
4,209,187 A * 6/1980 Forrest ..... 281/19.1
4,420,282 A * 12/1983 Axelrod ..... 412/4
5,078,563 A * 1/1992 Lolli ..... 412/8
5,183,294 A * 2/1993 Jukola et al. ..... 281/23
5,308,208 A * 5/1994 Ranson ..... 412/5
5,340,155 A * 8/1994 Podosek
5,403,138 A * 4/1995 Otake et al. ..... 412/1
5,868,539 A * 2/1999 Rathert ..... 412/5
6,039,494 A * 3/2000 Pearce ..... 402/73
6,250,867 B1 * 6/2001 Gwyn et al. ..... 412/19
2002/0009352 A1 * 1/2002 Nakabayashi ..... 412/1

* cited by examiner

*Primary Examiner*—A. L. Wellington
*Assistant Examiner*—Mark T. Henderson
(74) *Attorney, Agent, or Firm*—Thompson Hine LLP

(57) ABSTRACT

This is to provide a cover suitable to hollow-backed binding and provide a binding method for an album and the like for obtaining a well-bound appearance using the cover at low cost and easy to turn over. A cover is composed of a decoration cloth, a pair of substratum paper and a spine affiche adhered on required positions on the back of the decoration cloth, an interconnected reinforcement paper adhered to substratum paper to create a space between a spine affiche and a reverse paper. Also, the present invention adopts a binding method for binding with a process of adhering a plurality of cardboards, wherein heat-soluble adhesive are applied on a binding side thereof to a back surface of a spine of the cover while the plurality of cardboards have intervals therebetween, a process of keeping a cover at a room temperature, a process of bulging and rounding a spine portion by stressing ravine portions of right and left while heat-soluble adhesive is consolidating, and a process of consolidating the heat-soluble adhesive completely by fixing and holding the same until cooled down to a room temperature.

2 Claims, 4 Drawing Sheets

COVER FOR AN ALBUM AND THE LIKE AND A BINDING METHOD USING THE SAME

BACKGROUND OF THE INVENTION

1. Field of the Invention

The present invention relates to a structure of a front cover for an album, a scrapbook and the like having intervals between cardboards wherein heat-soluble adhesive are used, and hollow-backed binding using a foresaid front cover.

2. Description of the Prior Art

There already exist an album, a scrapbook and the like bound with intervals between cardboards using heat-soluble adhesive. For example, a cardboard book disclosed in Japanese Utility Model Official Gazette No. S63-25176 has a structure comprising a cover body having a cover portion a, a cover portion b and a spine portion c, a plurality of cardboards d positioned as shown in FIG. 5 having intervals equivalent to a predetermined thickness of a cardboard, and in the vicinity of an edge at a binding side of the plurality of cardboards, heat-soluble adhesive e intervening between cardboards to keep the intervals and gluing an edge surface of the edge at a binding side of the plurality of cardboards to an inside of the spine. Types of cardboards vary in applications from for a photo album, a postcard album, a stamp collection book, a coin collection book to a scrapbook.

Owing to such cardboard book, a bound book having intervals between cardboards is easily obtained at low price. Also an album, wherein an end of an album does not exceed a width of a spine even if a binder insert gets thicker by placing pictures on a binder insert, can be offered.

However, a backstrip of a cardboard (an edge portion at a binding side) comparatively becomes pliable because of a structure of such bound book having intervals between cardboards using heat-soluble adhesive. Therefore, the cardboard could not be used in conventional binding methods such as round-arch-spine binding and hollow-backed binding, wherein a hard backstrip is required. For the reason above, under the present condition, only bound books of low cost have been commercialized such as a handy-binding-type album, wherein a binder insert is directly adhered to the squarish spine.

An album has an essential product character, which is to store and keep photographs and other memorials for many years. For that reason, gorgeous and luxurious types of albums are required as well as low price and handy types thereof. A problem has been pointed out that a product of earnest binding type such as round-arch-spine binding and hollow-backed binding cannot be provided with the structure described above.

Here round-arch binding are further explained. According to conventional round-arch binding, a backstrip of a binding object is shaped into a round and then a cover is covered along therewith. Not that a backstrip of a binding object is formed in accordance with a round-arch-spine, but that a spine has to be shaped into a round to suit the backstrip of the binding object. Accordingly, cardboards having intervals therebetween and hinged binder inserts for an album are difficult in binding and impossible to use in round-arch binding.

The present applicant previously filed a Japanese patent application No. 2000-146408, wherein a spine affiche is resinous synthesis paper and heat-formed to obtain a round-arch binding. However, a spine of a bound book produced by this technology is fixed, which indicates that a problem of difficulty in turning over to double spread still remains unsolved.

SUMMARY OF THE INVENTION

In the view of the problem, the present invention provides a cover suitable for hollow-backed binding in binding having intervals between cardboards using heat-soluble adhesive and allows to obtain a well-bound appearance easily at low cost by suggesting a binding method using the cover. Also, the present invention has a purpose to provide an album, which is luxurious in appearance, easy to turn over to facing pages and easy to use.

To solve the each problems, the invention described in claim 1 adopts a structure comprising a decoration cloth, a pair of substratum paper and a spine affiche adhered on a predetermined position in a back surface of the decoration cloth, an interconnected reinforcement paper adhered on substratum papers of right and left to form space between a spine affiches and a reverse paper sheathing a back surface of the cover.

As space is formed between a spine affiche and an interconnected reinforcement paper, a cover of the above structure can be hollow-backed binding with the space after binding.

The invention described in claim 2 adopts a binding method having a process of adhering a plurality of cardboards, wherein heat-soluble adhesive are applied on a binding side thereof, to a back surface of a spine of a cover described in claim 1 while the plurality of cardboards have intervals therebetween, a process of keeping a cover, which is closed, at a room temperature, a process of bulging and rounding a spine portion by stressing from ravine portions of right and left outside of a cover in the middle of a state that heat-soluble adhesive is consolidating, and a process of consolidating the heat-soluble adhesive completely by fixing and holding the same until cooled down to a room temperature.

According to the above binding method, a bound book with a round-spine is obtained by an eminently simple process. Also, as a spine affiche and an interconnected reinforce paper is not adhered together in the cover, a bound book is able to have a round-spine meanwhile being a hollow-backed binding. Therefore, a well-bound appearance can be obtained easily at low cost and a luxurious album can be produced. Moreover, an album, which is easy to turn over and to see facing pages can be provided with hollow-backed binding.

DETAILED DESCRIPTION OF THE PREFERRED EMBODIMENT

Figure 1A:
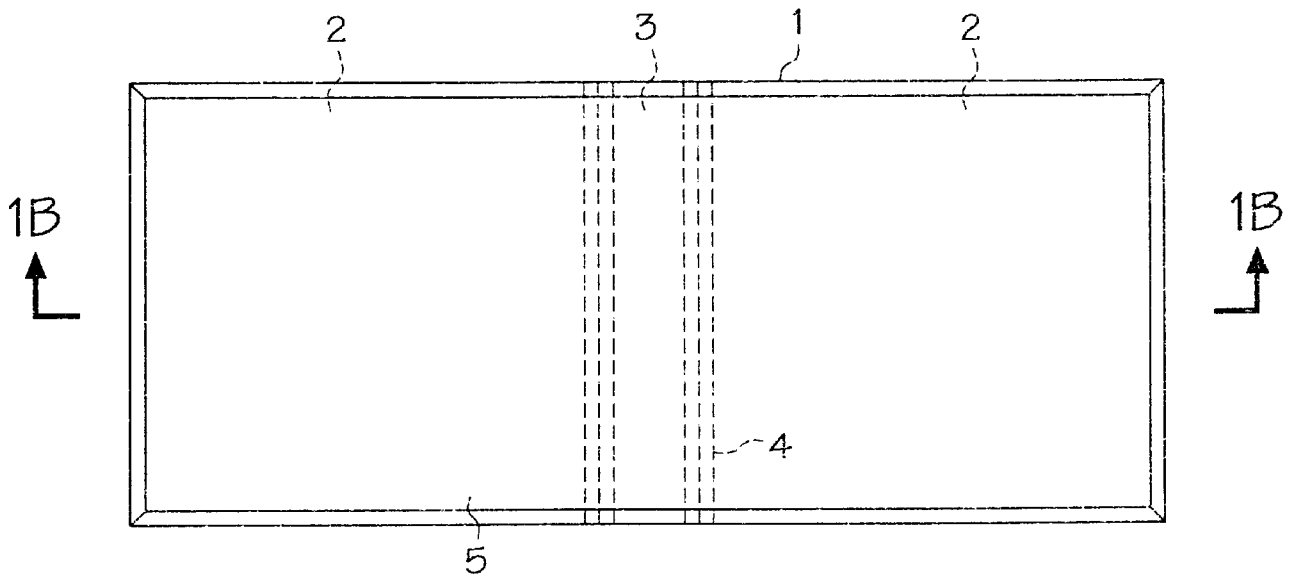
FIG. 1A is a plane view showing an example of a cover in the present invention. B is a cross sectional view taken along with A—A.
Figure 1B:
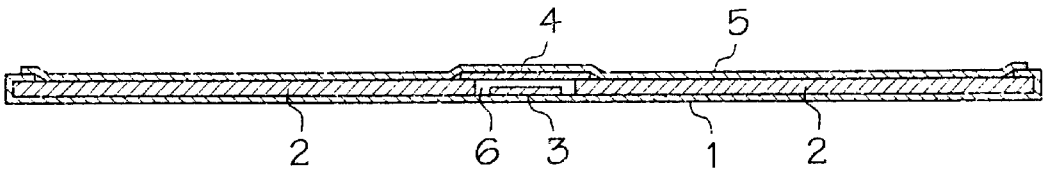

Hereafter, preferred embodiments of a cover for an album and the like in the present invention is described referring to drawings. FIG. 1 is a plane view showing an example of a cover for an album and a cross sectional view taken along with A—A lines. In this Figure, 1 is a decoration cloth sheathing the whole cover, 2 is a pair of substratum paper to be a base body of a cover and 3 is a spine affiche to be a base substance of a spine. 4 is an interconnected reinforcement paper adhered on substratum paper of right and left 2 to cover the spine affiche 3 on a back surface of a cover and 5 is a reverse paper sheathing the whole of a back surface of a cover A manufacturing procedure of this cover is to apply an adhesive on all over a back surface of a decoration cloth 1 and to adhere substratum paper of right and left 2 and a spine affiche 3 to predetermined positions. Then, after turning up top and bottom of the decoration cloth 1, proceed to turning up and adhering an end portion thereof. Corners are treated suitably. Then a belt-shaped interconnected reinforcement paper 4 is adhered to substratum paper of right and left 2 for sheathing a spine affiche 3 while creating a space 6 between the spine affiche 3 by keeping apart. A reverse paper 5 is adhered to the whole of a back surface while keeping a slight of space at four corners. A cover of an album is produced with the above processes.

After binding, a cover of the above structure can be in the state of hollow-backed with a space 6 as a spine affiche 3 and an interconnected reinforcement paper 4 is apart from each other by the space 6.

Figure 2:
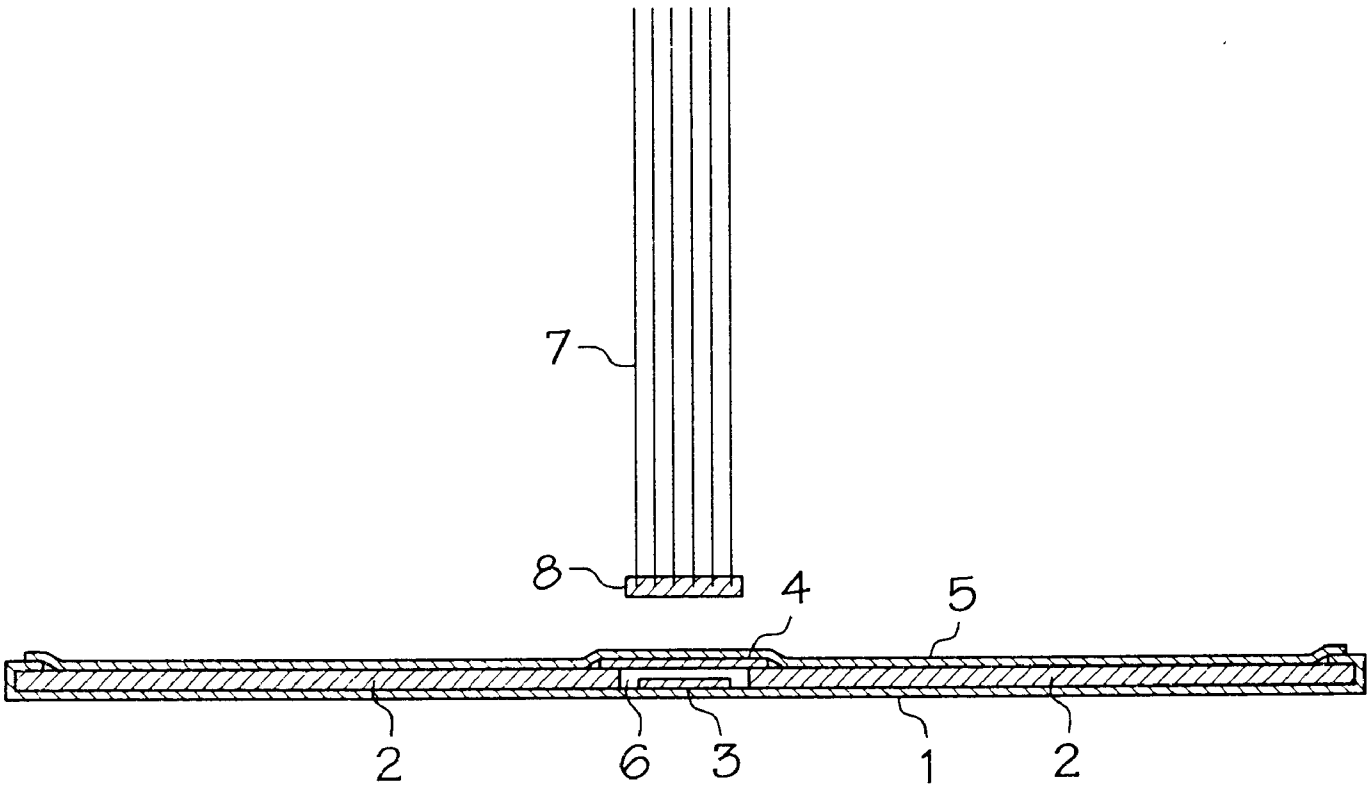
FIG. 2 is a description of a binding method in the present invention.
Figure 3A:
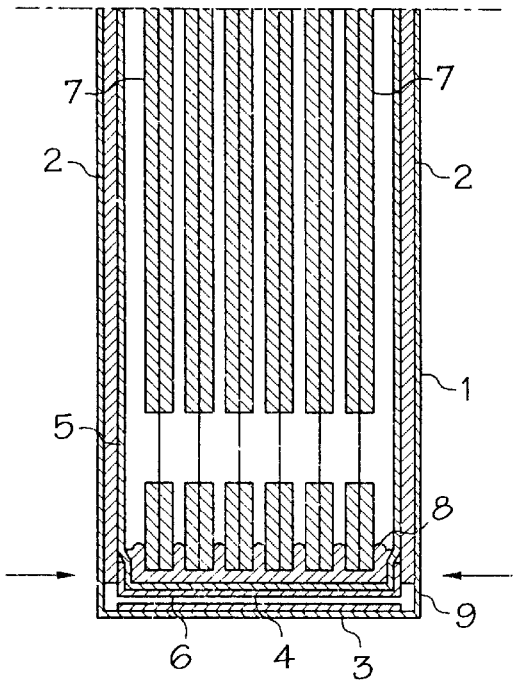
FIG. 3 is a description of a method for rounding a spine.
Figure 3B:
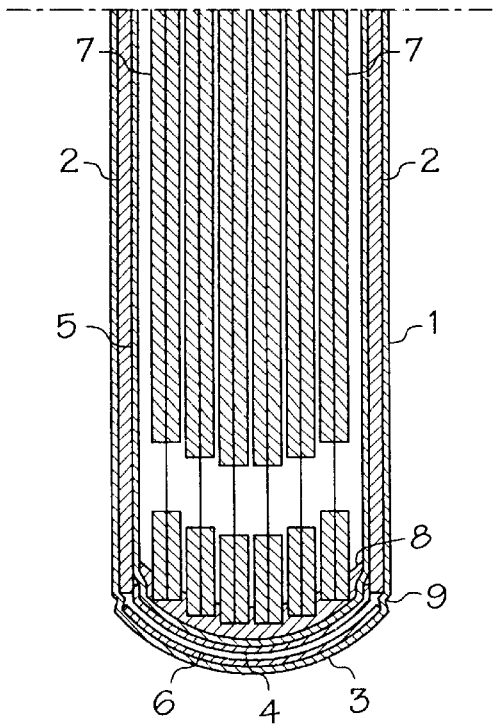

Hereinafter, a binding method using this cover is to be described. As shown in FIG. 2, cardboards 7, wherein heat-soluble adhesive 8 is applied on a biding side thereof while maintaining intervals therebetween are adhered on a back portion of spine of the cover opened. This is the same procedure with conventional binding using heat-soluble adhesive. For example, a spacer is positioned between a plurality of cardboards 7 and a pair of holders (not shown in figures) is to hold thereof. Then a binding side of the cardboards is applied with heat-soluble adhesive and pressed to adhere to a back surface of a spine.

As shown in FIG. (A), a cover is kept closed and stood at a room temperature. At the point that heat-soluble adhesive 8 is cooled down and solidified to some extent, a pressure is put on a portion to be a ravine portion 9 from right and left outside of a front cover with a suitable method. With the pressure, a ravine portion 9 is compressed to the direction of a width of a book, which results in spine bulged outside. By keeping this situation until heat-soluble adhesive 8 is cooled down to a room temperature, heat-soluble adhesive is to be completely solidified maintaining a rounded shape. As a spine affiche is settled in a rounded shape, a bound book with a cover rounded can be obtained.

Figure 4:
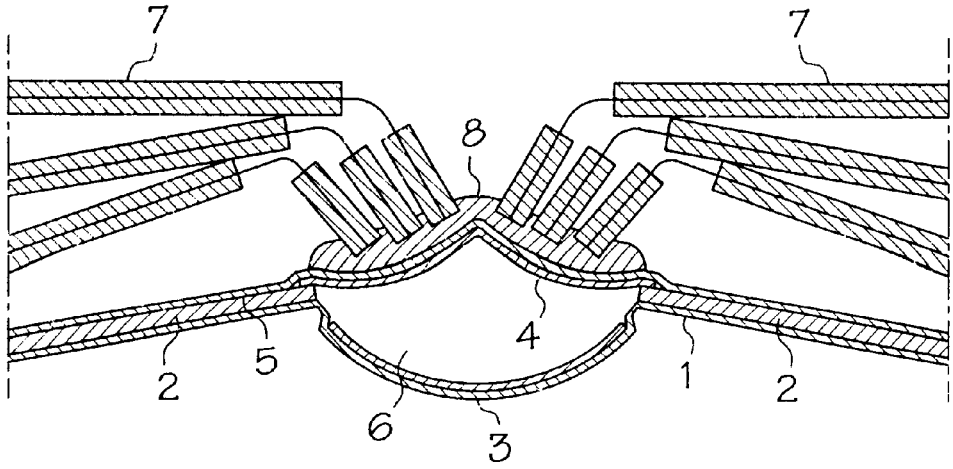
FIG. 4 is partially enlarged sectional view showing the state of a bound book being opened.
Figure 5:
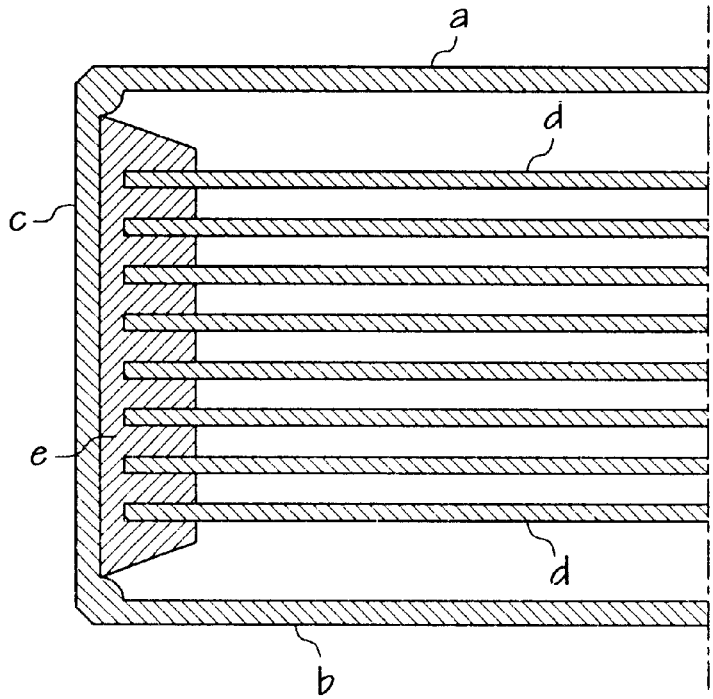
FIG. 5 is partially enlarged sectional view showing an example of a conventional bound book.

As a spine affiche 3 and an interconnected reinforcement paper 4 in a bound book produced by the above method is not adhered together, a space 6 is formed inside of a spine of a bound book, and therefore, as shown in FIG. 4, when cover is opened, a bound book can be a hollow-backed binding with a cylindric space.

As described above, a cover for an album and the like in the present invention adopts a structure providing an interconnected reinforcement paper on a spine affiche while keeping them apart. With such a structure, even contents are adhered to a spine, a space is formed so that hollow-backed binding is produced easily. Accordingly, a bound book is easy to turn over and to see without a cardboard stood.

Also, according to the binding method described above, a rounded cover can be composed with an exceedingly simple way as a spine is bulged with a pressure on a ravine portion of a cover from right and left outside. In a binding having intervals between cardboards, a well-bound appearance book such as a luxurious album can be provided with a rounded cover easily at low cost.

A rounded portion of a spine has a double structure of a spine affiche and an interconnected reinforcement paper and can be hollow-backed binding, which provides an album easy to open and see double spread.

What is claimed is:

1. A cover for an album and the like comprising a decoration cloth, a pair of substratum paper and a spine affiche adhered on a predetermined position in a back surface of the decoration cloth, wherein said pair of substratum paper comprises a right substratum paper and a left substratum paper and said spine affiche is disposed between said right substratum paper and said left substratum paper, an interconnected reinforcement paper adhered on said substratum papers extending from the right substratum paper to the left substratum paper to form a space between the spine affiche and the interconnected reinforcement paper wherein each of the right substratum paper, the left substratum paper and the reinforcement paper has a front surface facing said decoration cloth and a back surface opposite said front surface and a reverse paper sheathing the back surface of each of the right substratum paper, the left substratum paper and the reinforcement paper.

2. A cover for an album and the like comprising a decoration cloth, a pair of substratum papers, a spine affiche, an interconnected reinforcement paper and a reverse paper, wherein said decoration cloth includes a front surface and a back surface and each of said substratum papers, said interconnected reinforcement paper, said spine affiche and said reverse paper includes a front surface facing the back surface of the decoration cloth and a back surface opposite said front surface;

the pair of substratum papers positioned on the back surface of the decoration cloth, said pair of substratum papers comprising a right substratum paper on a right side of said cloth and a left substratum paper on a left side of said cloth;

the spine affiche positioned on the back surface of the decoration cloth between the right and left substratum papers;

each substratum paper having an inside edge adjacent said spine affiche;

wherein the interconnected reinforcement paper is adhered to the back surface of each substratum paper and extends from the back surface adjacent the inside edge of the right substratum paper to the back surface adjacent the inside edge of the left substratum paper thereby forming a space between the interconnected reinforcement paper and the spine affiche;

and the reverse paper sheaths the back surfaces of the substratum papers and the interconnected reinforcement paper.

* * * * *